US005778830A

United States Patent [19]

Wall

[11] Patent Number: 5,778,830

[45] Date of Patent: Jul. 14, 1998

[54] CLOSED FRAME SOOTBLOWER WITH TOP ACCESS

[75] Inventor: H. Davis Wall, Chattanooga, Tenn.

[73] Assignee: Combustion Engineering, Inc., Windsor, Conn.

[21] Appl. No.: 775,931

[22] Filed: Jan. 2, 1997

[51] Int. Cl.[6] ..... F22B 37/18; A47L 5/38

[52] U.S. Cl. ..... 122/379; 15/317

[58] Field of Search ..... 122/379, 390; 15/316.1, 317; 165/95

[56] References Cited

U.S. PATENT DOCUMENTS

| | | | |
|---|---|---|---|
| 2,668,978 | 2/1954 | De Mart . | |
| 2,883,694 | 4/1959 | Hibner, Jr. et al. | 15/317 |
| 2,897,532 | 8/1959 | Cantieri . | |
| 3,216,045 | 11/1965 | McColl | 15/317 |
| 3,439,376 | 4/1969 | Nelson et al. . | |
| 3,585,673 | 6/1971 | Nelson et al. . | |
| 3,604,050 | 9/1971 | Nelson et al. | 15/317 |
| 3,608,125 | 9/1971 | Nelson | 15/317 |
| 4,229,854 | 10/1980 | Johnston, Jr. . | |
| 4,351,082 | 9/1982 | Ackerman et al. . | |
| 4,387,481 | 6/1983 | Zalewski . | |
| 4,803,959 | 2/1989 | Sherrick et al. . | |
| 4,907,542 | 3/1990 | Maeyama et al. . | |
| 5,299,533 | 4/1994 | Johnston, Jr. et al. . | |
| 5,353,996 | 10/1994 | Gallacher et al. . | |
| 5,365,890 | 11/1994 | Johnston, Jr. et al. | 122/379 |
| 5,429,076 | 7/1995 | Johnston, Jr. et al. . | |
| 5,451,002 | 9/1995 | Amuny | 122/379 X |
| 5,667,139 | 9/1997 | Dickie | 15/317 X |

OTHER PUBLICATIONS

The Bergemann Report, vol. 1, Jun. 1989, "Recovery Service Sootblower Presented at Montreal Exfor Paper Show".

Bergemann, "Sootblowers".

*Primary Examiner*—Christopher Kilner

*Attorney, Agent, or Firm*—Alfred A. Stadnicki, Esq.

[57] ABSTRACT

A frame for housing a retractable sootblower, having a movable carriage and lance tube for cleaning inside surfaces of a boiler, includes a front end wall disposed proximate and a rear end wall disposed distal to the boiler. A pair of opposed side walls, each having one end connected to the front end wall and the other end connected to the rear end wall, are also provided so as to generally define a rectangular box. Also included are one or more top panels, each configured to extend between the opposed side walls with the panels in a closed position to thereby provide protection to the sootblower from above and to be moveable to an open position to provide substantially unobstructed access to the carriage from above the frame.

17 Claims, 6 Drawing Sheets

CLOSED FRAME SOOTBLOWER WITH TOP ACCESS

TECHNICAL FIELD

The present invention relates to sootblowers for cleaning inside surfaces of a boiler, and more particularly to a closed frame sootblower which provides top access to sootblower components.

BACKGROUND ART

In the combustion of fuels used to power industrial, utility and other types of boilers, by-products such as soot, ash and slag often accumulate on the interior surfaces of the boiler. The accumulation of these by-products decreases the efficiency of the heat transfer. Accordingly, to clean such by-products from the heat exchanging surfaces of the boiler, sootblowers are conventionally utilized.

Typically, sootblowers include a tubular lance which extends through a port in the boiler wall. A cleaning medium such as steam is then introduced via the lance to wash the inner surfaces of the boiler to remove the combustion by-products. In large boilers, retractable sootblowers are commonly utilized. The lance of the retractable sootblower is mounted to a carriage which is supported by parallel tracks mounted inside the sootblower frame or housing. When the sootblower is operated, the carriage is driven by an internal motor along the tracks to insert or inject the lance tube into the boiler during sootblower operation to discharge the cleaning medium against the heat exchanging surfaces of the boiler and thereby clean the combustion by-products from the boiler's interior. After the lance has been fully extended into the boiler, the travel direction of the carriage is reversed to withdraw the lance from the boiler. Retractable sootblower carriages could be adapted to insert and withdraw the lance tube multiple times during each operational period. However, sootblowers are most typically designed such that the lance tube is inserted once and withdrawn during each operational period. When the retractable sootblower is not in operation, the carriage remains in its parked position at the back end of the sootblower housing.

The reversal of the travel direction of the carriage requires that a limit switch be provided to limit the carriage movement. Conventionally, limit switches are mounted at each end of the sootblower frame and connected to the carriage motor by electrical cable. As the carriage moves from a parked position at the rear of the sootblower frame towards the boiler, it makes contact with the front limit switch which reverses the direction of current being supplied to the carriage motor thereby reversing the direction of movement of the carriage. The carriage then moves towards the rear of the sootblower frame until making contact with the rear limit switch which opens the circuit between the power source and the carriage motor thereby stopping the motor's operation and the further movement of the carriage. Of course, if it is desired that the sootblower cycle multiple times during each operational period, a more robust rear limit switch will be required.

The interior temperatures of boilers in which retractable sootblowers are used is typically extremely high. Furthermore, the gases which form part of the combustion by-products are highly corrosive. These extremely hot and corrosive gases can escape from the boiler interior through the lance tube insertion port. To reduce the transfer of heat and corrosive gas to the sootblower, a wall box may be installed on the boiler wall to cover the lance tube injection port. However, in practice, although this may reduce the heat and gas transferred to the sootblower housing, even using a wall box, the hot gases escaping into the sootblower housing will result in an extremely harsh environment in the area closest to the boiler which is particularly damaging to electrical and mechanical components. Hence, in conventional sootblowers, the front limit switch is subjected to extreme heat and corrosion. Therefore, this limit switch is typically a high maintenance item which must be frequently serviced and replaced.

Conventional sootblower housings are sometimes referred to as closed frame or open frame housings or beams. Closed frame housings may, for example, be made of one or more metal plates formed into an elongated inverted U-shaped member which houses and supports the sootblower carriage and lance tube, the limit switches and other sootblower components. Metal plates are typically welded on both ends of the elongated inverted U-shaped member to form a substantially rectangular box housing for the sootblower components. The front end of the housing is supported from the boiler wall or a wall box attached thereto. The rear or back end of the housing is most often supported from the surrounding structural steel framing. This configuration provides protection for the sootblower components from above and allows substantially unobstructed access to the sootblower components from below. Although the upper portion of the inverted U-shaped housing protects the sootblower components from above, it also obstructs access to these components from above and traps the hot corrosive gases which escape from the boiler interior within the housing.

Conventional open sootblower frames have been utilized to provide substantially unobstructed access to the sootblower carriage, lance tube and other components from above. Such frames also provide improved dissipation of hot gas emissions from the boiler. Even in open frame systems, installation and removal of sootblower components from above is often obstructed to some extent by removable stiffening members installed between the upper side walls of such sootblower frames for lateral stability, and by the tracks or rails which guide the carriage movement. While open frame systems improve the venting of hot corrosive gases escaping through the lance tube injection port and improve access to the sootblower components from above, these benefits come at the cost of having the sootblower components unprotected from above. Further, even if the sootblower components are accessible from above and below, the location of structural support steel, boiler piping and other boiler related components in the vicinity of the sootblower may make it difficult to access, install or remove sootblower components on-site.

Frequently, the lance tube is designed to be positioned off center. This is typically characterized as handedness. A sootblower is characterized as having lefthandedness or righthandedness depending on the side of the frame on which the lance tube valve operating mechanism is located from the perspective of an observer looking from the back end of the sootblower frame towards the boiler. Due to, for example, field modifications to the boiler system or the structural steel support framing, it is sometimes necessary to change the handedness of the sootblower. However, such a change is often difficult, if not impossible to accommodate with conventional sootblower frames.

OBJECTIVES OF THE INVENTION

Accordingly it is an object of the present invention to provide a closed frame sootblower with enhanced hot gas dissipation properties and which allows top access to sootblower components including the carriage, and lance tube.

It is a further object of the present invention to provide a sootblower frame which is easily reversible between right-handed and lefthanded operation.

It is yet another object of the present invention to provide a sootblower frame which allows carriage access from the rear.

Still another object of the present invention is to provide a sootblower frame which better facilitates installation and removal of the carriage from above the frame.

Additional objects, advantages, novel features of the present invention will become apparent to those skilled in the art from this disclosure, including the following detailed description, as well as by practice of the invention. While the invention is described below with reference to a preferred embodiment (s), it should be understood that the invention is not limited thereto. Those of ordinary skill in the art having access to the teachings herein will recognize additional implementations, modifications, and embodiments, as well as other fields of use, which are within the scope of the invention as disclosed and claimed herein and with respect to which the invention could be of significant utility.

SUMMARY DISCLOSURE OF THE INVENTION

According to the present invention, a frame for housing a retractable sootblower, having a movable carriage and lance tube for cleaning inside surfaces of a boiler, includes a front end wall disposed proximate and a rear end wall disposed distal to the boiler. A pair of opposed side walls, each having one end connected to the front end wall and an opposed end connected to the rear end wall, are provided to generally define a rectangular box in which the carriage and lance tube are housed. The opposed side walls may, for example, be formed of channel members with inwardly extending flanges.

One or more top panels, extend between the opposed side walls when in a closed position to provide protection to the sootblower from above. The top panels, which may beneficially be grated panels, are moveable to an open position to provide substantially unobstructed access to the carriage and/or lance tube from above the frame for servicing. Preferably, one or more hinges are connected to one of the side walls and to each top panel so that each panel is rotatable about at least one hinge between the open and closed positions. The hinges may be non-removably connected to the top panels and the side walls.

In accordance with other aspects of the invention, the front and rear end walls are removably connected, with suitable removable connectors, to the opposed side walls. Accordingly, the front and rear walls can be easily changed to modify the handedness of the sootblower between right-handed and lefthanded operation. By removing the rear end wall, installation and removal of the carriage can also be performed from the rear of the frame without obstruction.

In accordance with still other aspects of the invention, a multi-sectional track is mounted to one or both of the opposed side walls within the rectangular box frame. Each track typically extends over a substantial portion of the length of the side wall to which it is mounted. The track(s) cooperate with the carriage to guide its movement as the lance tube is inserted into and withdrawn from the boiler. The track(s) also support the carriage within the rectangular frame box. One section, e.g. a rear section, of each multi-sectional track is removably mounted to its associated side wall. The other sections of each multi-sectional track are permanently mounted to the side wall. By removing the removably mounted track section(s), installation and removal of the carriage from above the frame is facilitated.

BEST MODE FOR CARRYING OUT THE INVENTION

Figure 1:
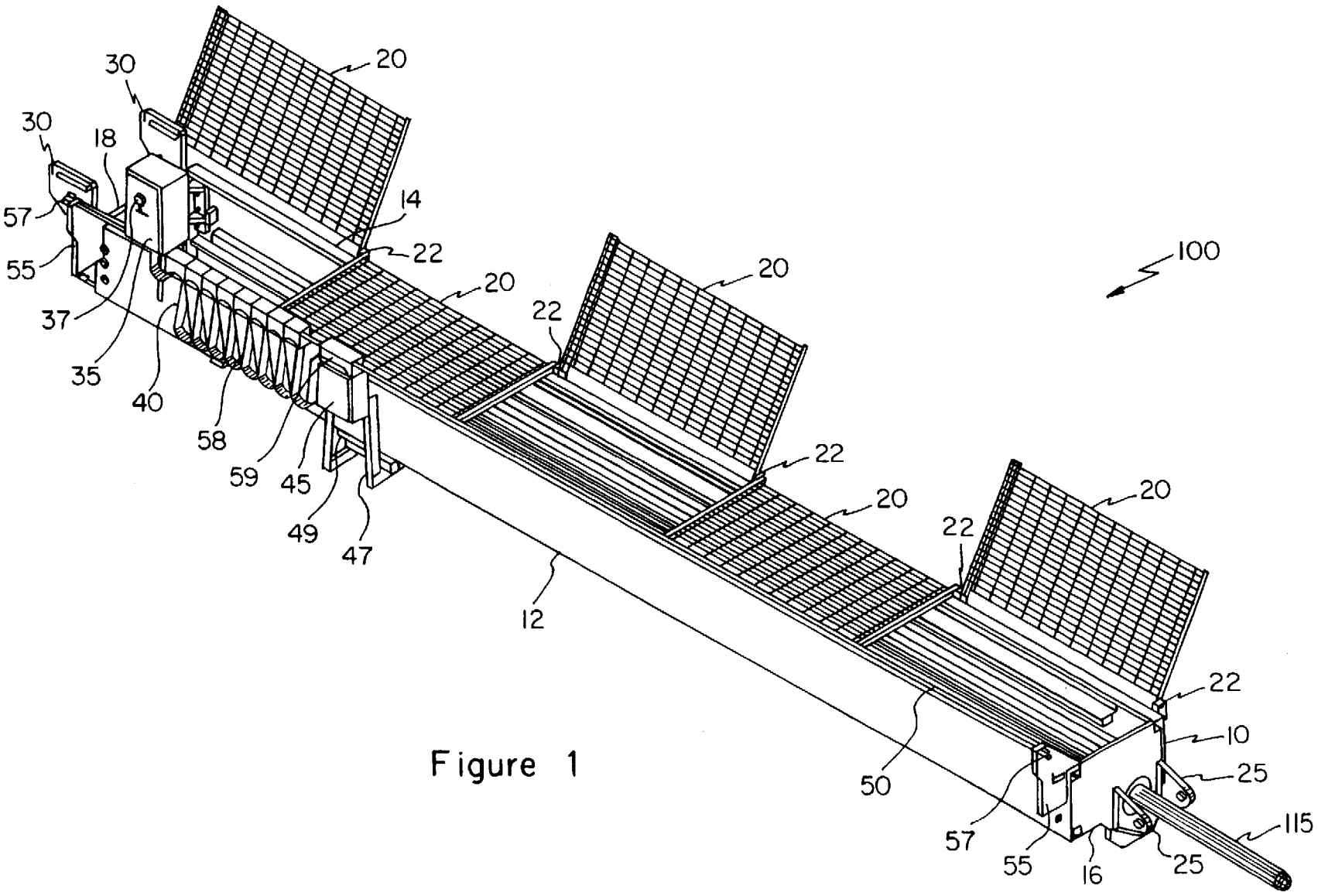
FIG. 1 is a perspective view of a retractable sootblower in accordance with the present invention.

FIG. 1 depicts a perspective view of a sootblower 100 in accordance with the present invention. The sootblower includes a frame 10 formed of opposed side walls 12 and 14 which in the embodiment shown are C15×3⅜ channel members flanged inwardly. The frame also includes a front wall 16 and rear wall 18. As will be described further below the front and rear walls are removably connected to the opposed side walls to form a generally rectangular shaped box for housing sootblower components. The frame also includes grated panels 20 which are connected to one of the side walls by hinge assemblies 22 at opposed corners of each panel 20.

The panels 20 are rotatable between closed and opened positions. When the panels 20 are in the closed position, they extend across the side walls hence closing the frame 10 and providing protection from above to the sootblower components housed within the frame 10, including lance tube 115. Because grated panels are used, hot corrosive gases escaping from the boiler through the lance tube port are not trapped within the frame 10 but will be quickly and continuously dispersed. When access to the sootblower components from above is required for maintenance, installation or removal, the panels can be opened as shown by alternate panels 20 in FIG. 1. The top panels 20 are opened by simply rotating each panel about its connecting hinge assemblies 22. The front wall 1G has support brackets 25 attached thereto for connecting the front end of the sootblower frame to a boiler wall box to support that end of the sootblower. The rear wall has support brackets 30 attached thereto for connection to, for example, structure steel framing which is in the vicinity of the back end of the sootblower to thereby provide two end support for the sootblower.

A starter cabinet 35 having a starter switch 37 is mounted to the side wall 12. An electrical power cable 40 extends between the starter box 35 and a junction box 45 which is in turn connected physically to the sootblower carriage by support structure 47 and member 49, as will be described further below. The cable 40 is festooned between the starter cabinet 35 and the junction box 45. Power, i.e., electrical current, is transmitted from the junction box 45 to the carriage motor via the limit switches. The cable 40 and junction box 45 are supported by a stainless steel bar 50 which extends between support brackets 55 attached to side wall 12 of the frame 10. Each of the support brackets 55 has an aperture through which the bar 50 extends. The ends of the bar 50 are threaded so that the bar 50 is locked in place by threaded nuts 57 which are tightened to tension the bar 50 between the support brackets 55 to remove, to the extent practicable, any sag in the support bar 50.

Eight festoon blocks 58, which are formed of nylon, connect the cable 40 to the bar 50 between the starter cabinet 35 and junction box 45. The number of festoon blocks 58 can be increased or decreased as desired for the particular implementation. A somewhat larger festoon block 59, which is also formed of nylon, connects the junction box 45 to the support bar 50. The nylon festoon blocks slide along the support bar 50 as the sootblower carriage moves between a parked position towards the rear of the frame and a position at which the sootblower lance tube 115 is fully inserted into the boiler interior.

It will be understood by those skilled in the art, that the top grated panels 20 could, if desired, be replaced by other panel designs. For example, perforated steel plates could be utilized in lieu of the grated panels. However, this could substantially increase the weight of the panels and hence make it more difficult to open the panels to gain access to sootblower components housed within the frame 10. It will also be recognized that other assemblies could be used to support the cable, so long as the assembly utilized provides support to the cable as the distance between the starter cabinet 35 and junction box 45 increases and decreases during operation of the sootblower.

Figure 2:
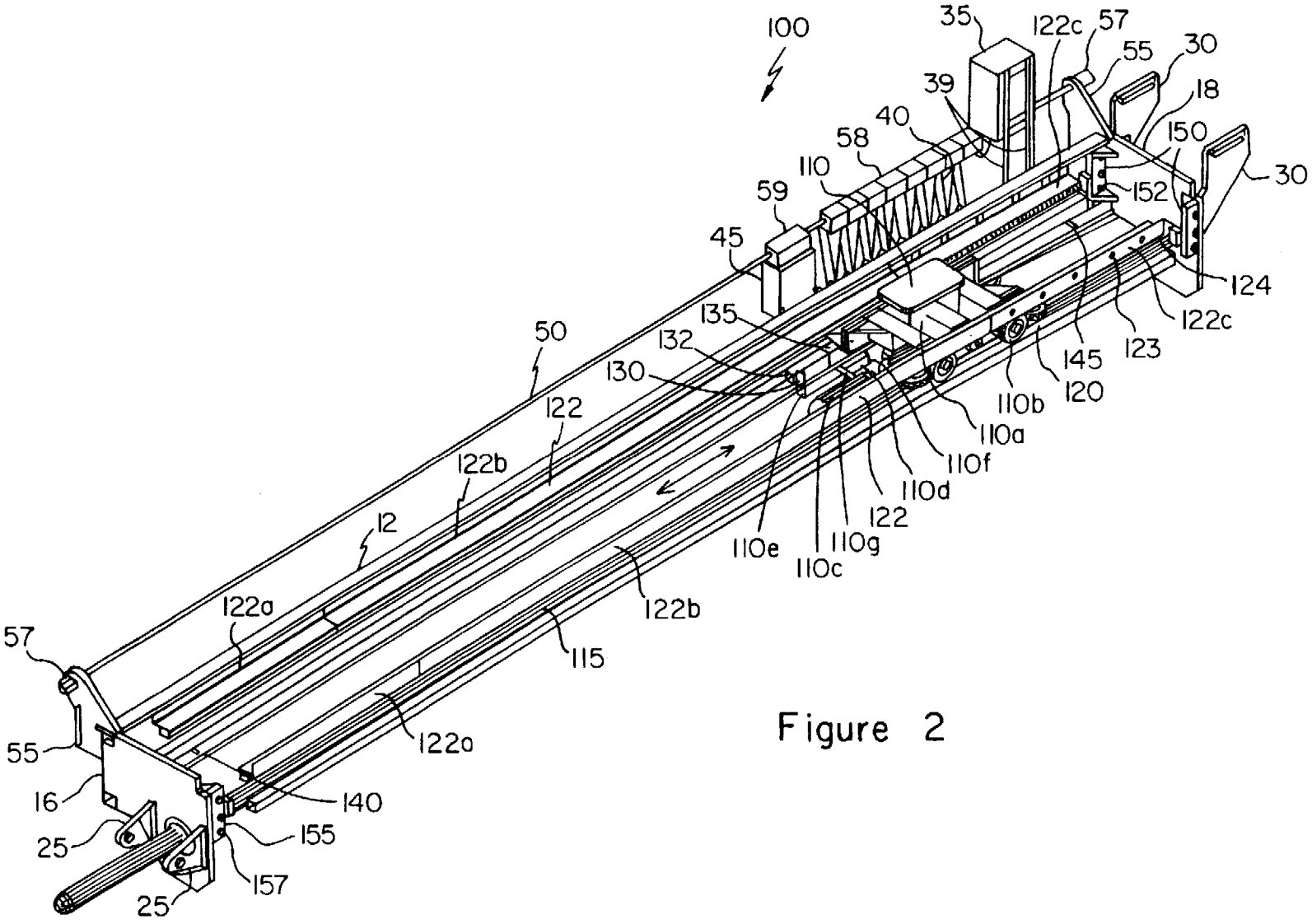
FIG. 2 is a perspective view of the FIG. 1 sootblower with the top panels and one side wall removed.

Turning now also to FIG. 2, a cutaway view of the sootblower 100 is depicted with one of the side walls and the top grated panels removed. As shown, the sootblower components housed within the frame include a carriage assembly 110 having a housing 110*a* to which a lance tube 115 is mounted. The carriage assembly 110 rides on wheels 10*b* along conventional lower guide tracks or rails 120 mounted to each of the side walls 12 which is shown and 14 which is not shown in FIG. 2. A multi-section upper guide track or rail 122 is formed of multiple sections of steel angle 122*a* 122*b* and 122*c*. Sections 122*a* and 122*b* are welded and hence permanently mounted to the side walls 12 and 14. Sections 122*c* are removably mounted with threaded connectors through the holes 123 formed in the vertical leg of each of the angles 122*c*. By opening the necessary grated panels 20, and unbolting track sections 122*c* , the carriage 110 can be easily removed from or installed in the sootblower frame 10.

As shown, the carriage assembly 110 includes an electrical motor 110*c* which is mounted to the carriage housing 110*a*. A bracket 110*d* is attached to the motor 110*c* housing and supports tubular members 110*e* and 110*f*. Mounted to tubular member 110*e* is a front limit switch 130. A rear limit switch 135 is mounted to the tubular member 110*f*. A pin 140, removably mounted to side wall 12, cooperates with the limit switch 130 to reverse the direction of the carriage 110 by reversing the current to the electrical motor 122 when the flexible whip member 132 of front limit switch 130 makes contact with the pin 140. The pin 140 is inserted through an aperture (not shown) in the side wall 12. By forming multiple apertures in the side wall 12, the pin 140 can be relocated as desired to increase or reduce the total travel distance of the carriage 110 between its parked disposition near the rear end of the frame 10 and the front of the frame 10.

Although not shown, a similar flexible whip member is also provided on the rear limit switch 135 which cooperates with a second pin 145 located towards the rear of the sootblower frame 10 to open the electrical circuit and thereby cut-off power to the carriage motor 110*c* when the carriage returns to the desired parked position. The de-energizing of the carriage motor ends operation of the sootblower. If each period of operation of the sootblower will require multiple cycling of the lance tube in and out of the boiler interior, a more robust rear limit switch will be required, as will be well understood by the artisan. However, customarily, the sootblower will run through a single cycle during each operation and a limit switch of the type shown will be sufficient. As with pin 140, pin 145 is removable and can be inserted in any of multiple apertures (not shown) formed in the side wall 12 towards the back end of the frame 10 to modify the location where the carriage will be parked during non-operation of the sootblower. Alternatively, if it is desired that the carriage always be parked in the same position, the pin 145 can be permanently mounted to the side wall 12.

Although the limit switches 130 and 135, and the corresponding pins 140 and 145, are shown to be in particular locations and supported in a particular manner, various alternatives exist for mounting the limit switches 130 and 135 and the pins 140 and 145. What is of primary importance is that the limit switches 130 and 135 are mounted to travel with the carriage 110. This ensures that the limit switches 130 and 135 are only subjected to the hot corrosive gases escaping from the boiler and into the front end of the frame 10 through the lance tube port during each operational period when the carriage moves to a position close to the front end of the frame 10. During all other periods, the carriage 110 and hence, the limit switches 130 and 135, will be parked proximate to the back end of the frame 10 and away from the escaping gas. Therefore, the limit switches will experience an extremely hot and corrosive environment during a substantially reduced period of time as compared with limit switches used in conventional retractable sootblowers. This in turn will reduce the amount of maintenance required on the limit switches 130 and 135 and will increase their operational life.

Brackets 155 are attached to the interior surface of both sides of the front wall 16 to provide for removable mounting of front wall 16 to the side walls 12 and 14 using threaded connectors 157. The mounting of front wall 16 in this manner allows the wall 16 to be removed and replaced by a mirror image wall to change the handedness of the sootblower from the righthanded disposition shown to a lefthanded disposition. This is particularly advantageous in situations where, for example, the handedness of the sootblower must be modified in the field. In changing the handedness of the sootblower 100, the pins 140 and 145 are moved to the other side wall 14 which will beneficially also include pre-drilled apertures to accept the pins.

Rear wall 18 has brackets 150 attached thereto which are connected by bolts 152 to the side walls 12 and 14 (not shown in FIG. 2) to mount the rear wall. Rear wall 18 has the steam inlet pipe passing therethrough in alignment with lance tube 115. To change the handedness of the sootblower 100, the rear wall 18 must also be removed and replaced by a mirror image wall. Removable mounting of the rear wall also allows rear wall 18 to be easily unbolted and removed to provide rear access for installation and removal of the carriage 110 and lance tube 115 from behind the sootblower.

Figure 3:
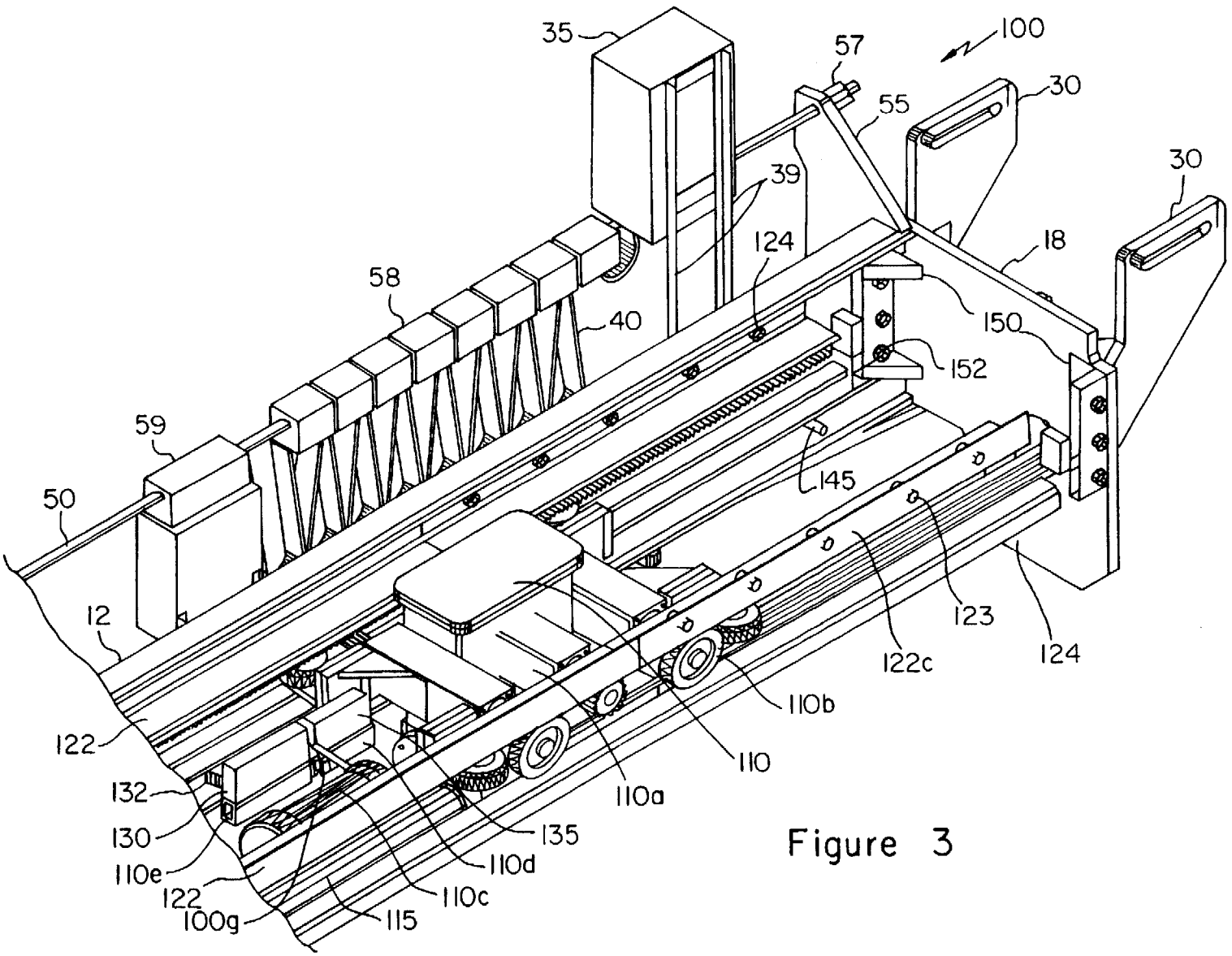
FIG. 3 is an enlargement of the back-end of the sootblower as shown in FIG. 2.

FIG. 3 depicts an enlarged view of the rear end of the sootblower 100 with the top panels and one of the side walls removed. The view is identical that depicted in FIG. 2 but enlarged for the convenience of the reader. Hence, only selected components of the sootblower 100 will be further discussed with reference to FIG. 3 to avoid unnecessary duplication.

As shown, the limit switches 130 and 135 are supported by the tubular members 110*e* and 110*f* which are connected to the housing of the electrical motor 100*c* by the bracket 110*g*. Limit switch 130 includes a flexible whip member 132 which mechanically operates the switch to change its circuitry and thereby reverse the current to the electrical motor 110*c* when the flexible member 132 physically contacts the pin 140 as the carriage 110 moves towards the boiler. The flex member 132, which could take the form of a spiral wound spring, bends as it contacts pin 140 to trip the limit switch 130 circuitry into a reversed current mode, as will be well understood by the skilled artisan.

A substantially identical flex member (not shown) is also included as part of limit switch 135 for contact with pin 145 to open the circuitry of limit switch 135 when the parked position is reached by the carriage 110. Since sootblower 100 is a single cycle sootblower, the lance tube moves through a single cycle during each operational period initiated by switch 37 on the starter cabinet 35. Accordingly, when the flexible member on the limit switch 135 contacts the pin 145, limit switch 135 is mechanically operated to shut off power to and hence de-energize the motor 110*c*.

As discussed above, one or both of the pins 140 and 145 are movable along the length of the sootblower frame 10 so that the travel distance and/or location of the carriage 110 in its parked disposition can be modified as desired. The travelling limit switches arranged as described herein can be advantageously utilized with any carriage and lance tube design.

As shown in FIG. 3, the starter cabinet 35 is supported from angular members 39 which are attached to the side wall 12 by the bolted connectors 124 which extend through holes 123 to also attach the removable sections 122*c* of the guide rails 122 to the side wall. This allows the starter cabinet 35 and supporting members 39 to be easily moved to the other wall 14 of the frame 10 if the sootblower handedness is changed.

Figure 4:
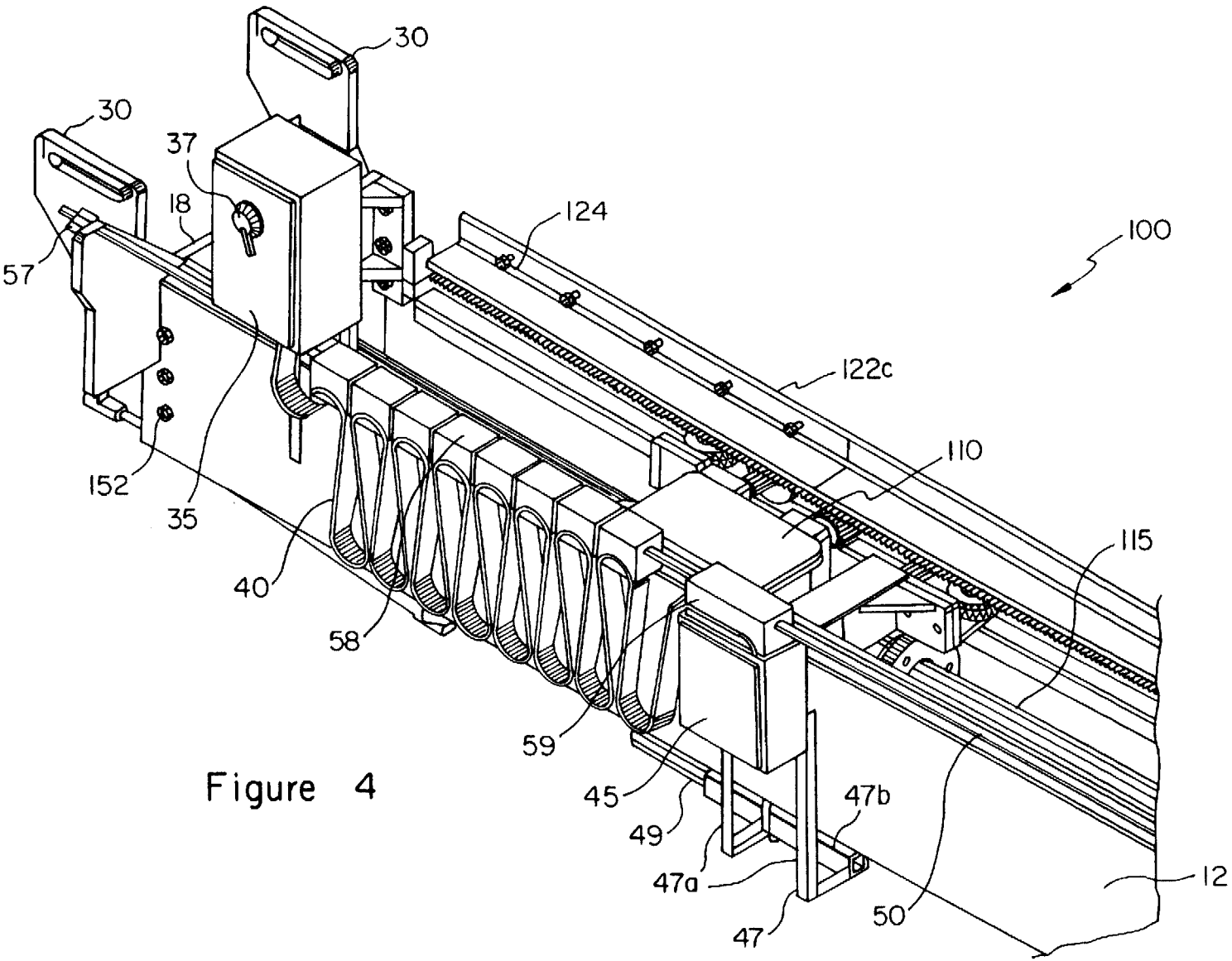
FIG. 4 is an enlargement of the back-end of the sootblower as shown in FIG. 1 with the top panels and one side wall removed.

FIG. 4 is an enlarged view of the back or rear end of the sootblower 100 with the panels 20 and the far side wall 14 removed. FIG. 4 will be particularly helpful in understanding the operation of the festoon system supporting the power cable 40 and junction box 45. As shown, the carriage assembly 110 includes a support member 49 attached thereto and moveable therewith for driving the movement of the junction box 45 with the carriage 110. More particularly, the junction box is attached to support structure 47 which is formed of structural angles 47*a* connected to a tubular member 47*b* which is in turn mounted to the support member 49. Support member 49 may be a tubular member with outer dimensions slightly smaller than the inner dimensions of the tubular member 47*b* such that member 49 can be inserted into member 47*b* and locked in place with, for example, a bolt or cotter pin (not shown) or by welding performed on site.

As the carriage 110 is driven by its motor 110*c* either towards or away from the boiler, the support member 49 moves therewith, thereby moving structure 47 and the junction box 45. The junction box 45 is, as previously described, also attached to a festoon block 59 which slides along the rod 50. As the junction box 45 is driven towards the boiler by the carriage 110, the cable 40 is pulled by the junction box 45, while remaining supported by the sliding festoon blocks 58 from the rod 50. The festoon system allows the length of the power cable 40 to be extended without interfering with the movement of the carriage 110 or junction box 45 until the travel direction is reversed by limit switch 130. As the carriage then moves away from the boiler, festoon block 59 pushes against festoon blocks 58 to fold cable 40 and thereby decrease the length of the cable 40 as the carriage 110 moves back to its parked position.

Figure 5A:
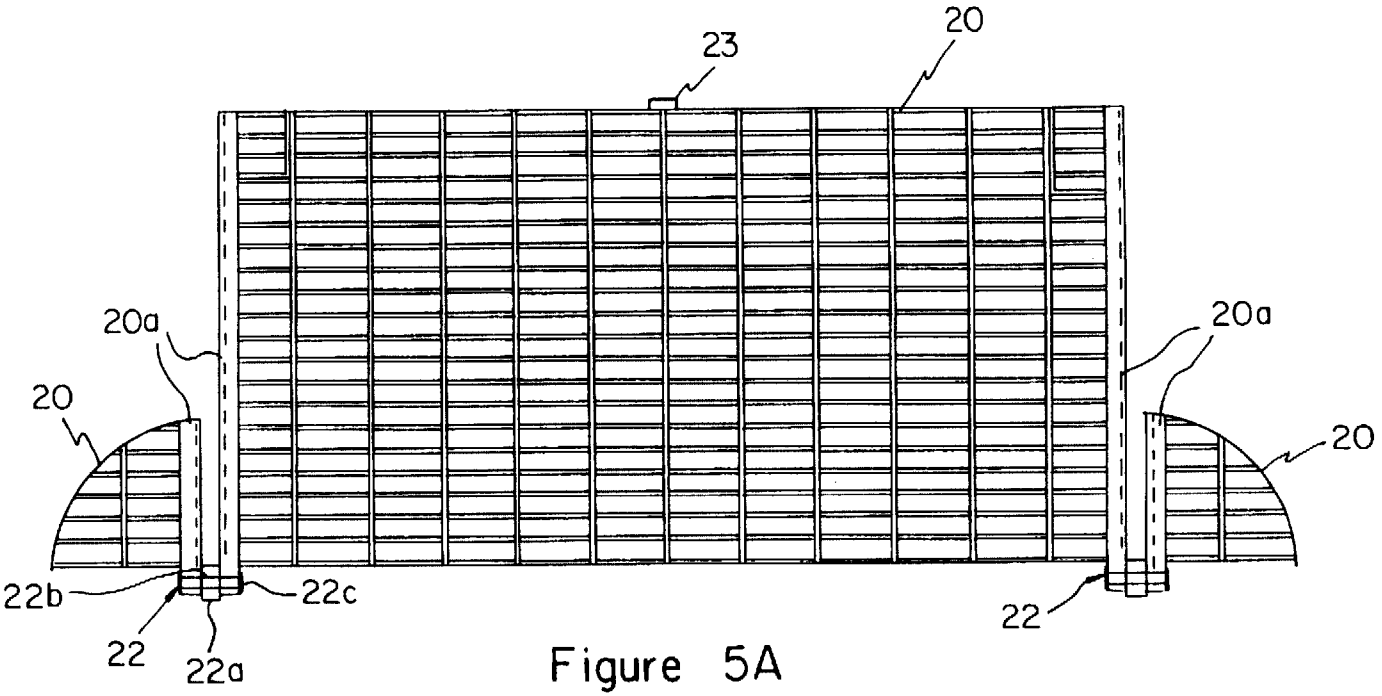
FIG. 5A is a top view of the top panels depicted in FIG. 1.
Figure 5B:
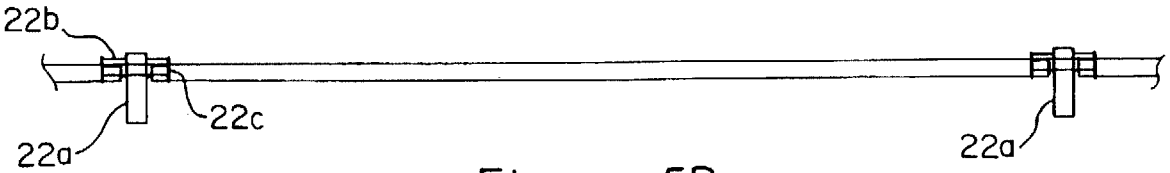
FIG. 5B is an elevation view of the top panels depicted in FIG. 5A.

FIG. 5A depicts a somewhat enlarged top or plan view and FIG. 5B depicts an elevation view of grated panels 20 and hinge assemblies 22. The panels 20 include side members 20*a* which are preferably in the form of structural steel angle members. An aperture is formed in one flange of each of the side members 20*a* to accept a pin 22*b*. Each hinge assembly 22 also includes a steel hinge plate 22*a* which is preferably welded to the exterior side of the side member 14. The pin 22*b* is inserted through the apertures in the adjacent side members 20*a* and the hinge plate 22*a* to rotatably connect the grated panels 20 to the frame 10. The pins 22*b* are permanently restrained by washers 22*c* which are welded to each end of the pins 22*b* and which may also be welded to the side members 20*a*. It will be understood that at each end of the frame 10, the hinge pin will connect only a single panel 20 to the hinge plate 22*a*. Accordingly, pins somewhat shorter than pins 22*b* can, if desired, be utilized at the ends of the sootblower frame 10.

As shown in FIGS. 5A and 5B, the grated panels 20 are formed of barstock having a height of one inch. The side members 20*a* have one inch flanges. Each panel's overall dimensions are approximately two by four feet, the two foot dimension corresponding to the separation between the vertical webs of the side walls 12 and 14. Larger or smaller panels could of course be used, the panel dimensions being dictated by the dimensions of the frame. For example, the dimension between the side walls will typically vary depending upon the carriage gear box size.

The non-hinged end of each grated panel 20 will beneficially be forced into contact with side wall member 12 by tension latch and keeper assembly 23 which, for example, may be of the type commercially manufactured by SOUTHCO, Incorporated under part numbers V2-0025-52 and V2-0018-52 or an equivalent thereto. The latch and keeper assembly 23 will, among other things, prevent vibration of the grated panels 20 against the side wall 12. The latched panels 20 may also provide some lateral support to the side walls 12 and 14, although this is unnecessary in the preferred embodiment which utilizes side walls in the form of channel members. The flanges of the channel members independently provide sufficient lateral stiffening.

Figure 6A:
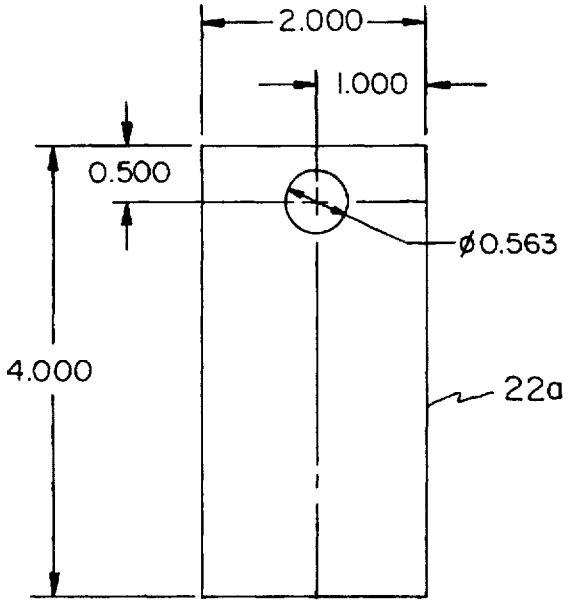
FIG. 6A is an elevation view of the hinge member shown in FIGS. 5A and 5B.
Figure 6B:
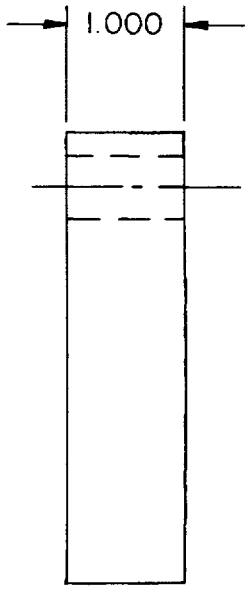
FIGS. 6B is a side view of the hinge member shown in FIG. 6A.
Figure 7B:
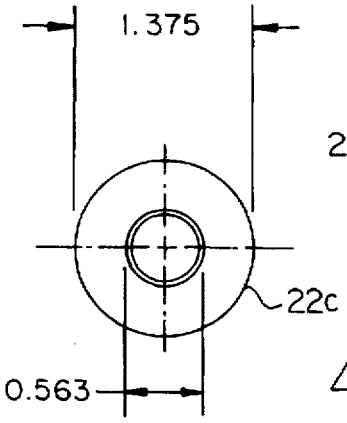
FIG. 7B provides further details regarding the restraining washer depicted in FIG. 7A.
Figure 7A:
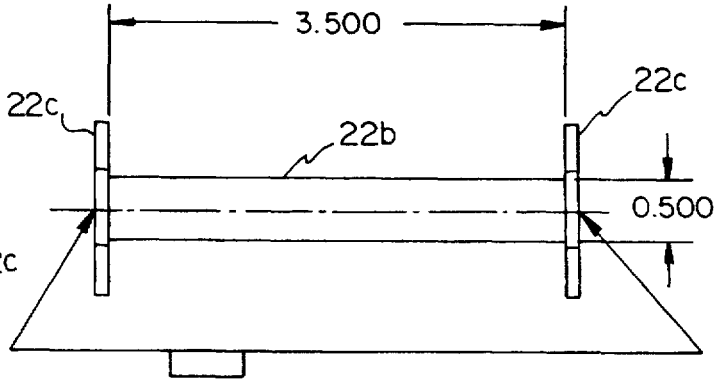
FIG. 7A details the hinge pin and restraining washers shown in FIGS. 5A and 5B.

FIGS. 6A and 6B depict a hinge plate 22*a* suitable for use in the embodiment of the sootblower 100 described above. FIGS. 7A and 7B depict a pin 22*b* formed of tubular steel and washers 22*c* which are preferably welded to the pin 22*b* as discussed above. As indicated, the restraining washers 22*c* have an aperture only slightly larger than the outer diameter of the pin 22*b*.

As described above, a closed frame sootblower is provided which beneficially includes grated top panels which can be moved to provide substantially unrestricted access to the sootblower components from above. Removable front and rear walls facilitate easy modification of the handedness of the sootblower. The removable rear wall also allows access to the carriage and tube from behind. Further, by utilizing upper carriage guides or rails which include a removable section, the removal and installation of the carriage from above is further facilitated.

To reduce the sootblower maintenance requirements, the carriage limit switches are designed to travel with the carriage and accordingly are kept away from boiler heat and escaping corrosive gases when the sootblower is not in operation, i.e. when the sootblower is in a parked disposition. By utilizing adjustable pins which cooperate with the moving limit switches, the travel distance of the carriage can be easily adjusted as may be desired. A festoon system facilitates the extension and retraction of the carriage power cable as the carriage moves towards and away from the boiler.

It will also be recognized by those skilled in the art that, while the invention has been described above in terms of one or more preferred embodiments, it is not limited thereto. Various features and aspects of the above described invention may be used individually or jointly. Further, although the invention has been described in the context of its implementation in a particular environment and for particular purposes, those skilled in the art will recognize that its usefulness is not limited thereto and that the present invention can be beneficially utilized in any number of environments and implementations. Accordingly, the claims set forth below should be construed in view of the full breath and spirit of the invention as disclosed herein.

I claim:

1. A frame for housing a retractable sootblower, having a movable carriage and lance tube for cleaning inside surfaces of a boiler, comprising:

a front end wall disposed proximate said boiler;

a rear end wall disposed distal to said boiler;

a pair of opposed side walls, each having one end connected to said front end wall and an opposed end connected to said rear end wall, thereby generally defining a rectangular box;

one or more top panels, each configured to extend between the opposed side walls with the panels in a closed position to thereby provide protection to the sootblower from above and to be moveable to an open position to provide substantially unobstructed access to the carriage from above the frame; and one or more hinges, each of said hinges being connected to one of the side walls and to one of said top panels;

wherein each of said top panels is rotatable about said connected hinge between the open position and the closed position.

2. A frame for housing a retractable sootblower according to claim 1, wherein said hinges non-removably connect each of the top panels to one of the side walls.

3. A frame for housing a retractable sootblower according to claim 1, wherein each of said top panels includes a side member having an aperture and each of said hinges includes:

a plate fixedly attached to one of the side walls and having an aperture, a pin member extending through the aperture in said side member and the aperture in said plate, a first restraining member fixedly attached to one end of said pin, and a second restraining member fixedly attached to the other end of said pin.

4. A frame for housing a retractable sootblower according to claim 3, wherein the plate is permanently affixed to one of the side walls.

5. A frame for housing a retractable sootblower according to claim 1, wherein the top panels are grated panels.

6. A frame for housing a retractable sootblower according to claim 1, wherein said side walls are in the form of channel members with inwardly extending flanges.

7. A frame for housing a retractable sootblower according to claim 1, wherein said front end wall and said rear end wall are removably connected to the opposed side walls.

8. A frame for housing a retractable sootblower according to claim 7, wherein said front end wall and said rear end wall are removable to change sootblower handedness.

9. A frame for housing a retractable sootblower according to claim 1, wherein said rear end wall is removably connected to the opposed side walls so as to facilitate installation and removal of the carriage from behind the frame.

10. A frame for housing a retractable sootblower according to claim 1, further comprising a multi-sectional track mounted to one of said opposed side walls within the rectangular box and configured to cooperate with said carriage to guide the movement thereof, one section of said multi-sectional track being removably mounted to facilitate installation and removal of the carriage from the above the frame.

11. A frame for housing a retractable sootblower according to claim 10, wherein the multi-sectional track extends over a substantial portion of a length of the one side wall and the other sections of said multi-sectional track are permanently mounted to the one side wall.

12. A frame for housing a retractable sootblower, having a removable carriage and lance tube for cleaning inside surfaces of a boiler, comprising:

a front end wall disposed proximate said boiler;

a rear end wall disposed distal to said boiler;

a pair of opposed side walls, each having one end connected to said front end wall and the other end connected to said rear end wall, thereby generally defining a rectangular box;

a top panel configured to extend between the opposed side walls with the panel in a closed position to thereby protect the sootblower from above and to be moveable to an open position to provide substantially unobstructed access to the carriage from above the frame; and a hinge connected to, one of the side walls and to said top panel;

wherein said front end wall and said rear end wall are removably connected to the side walls.

13. A frame for housing a retractable sootblower according to claim 12, wherein said hinge non-removably connects the top panel to one of the side walls.

14. A frame for housing a retractable sootblower according to claim 12, wherein said front end wall is removably connected to the opposed side walls by threaded connectors.

15. A frame for housing a retractable sootblower, having a movable carriage and lance tube for cleaning inside surfaces of a boiler, comprising:

a front end wall disposed proximate said boiler;

a rear end wall disposed distal to said boiler;

a pair of opposed side walls, each having one end connected to said front end wall and the other end con nected to said rear end wall, thereby generally defining a rectangular box;

a top panel configured to extend between the opposed side walls with the panel in a closed position to thereby protect the sootblower from above and to be moveable to an open position to provide substantially unobstructed access to the carriage from above the frame; and a hinge connected to one of the side walls and to said top panel;

wherein said rear end wall is removably connected to the side walls so as to facilitate removal and installation of the carriage from behind the frame.

16. A frame for housing a retractable sootblower according to claim 15, wherein said hinge non-removably connects the top panel to one of the side walls.

17. A frame for housing a retractable sootblower according to claim 15, wherein said rear end wall is removably connected to the opposed side walls by threaded connectors.

* * * * *